US008050585B2

(12) United States Patent
Gunbe

(10) Patent No.: US 8,050,585 B2
(45) Date of Patent: Nov. 1, 2011

(54) SURFACE POTENTIAL DETECTING DEVICE OF IMAGE FORMING APPARATUS

(75) Inventor: Eiji Gunbe, Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 548 days.

(21) Appl. No.: 12/206,063

(22) Filed: Sep. 8, 2008

(65) Prior Publication Data

US 2009/0067871 A1 Mar. 12, 2009

Related U.S. Application Data

(60) Provisional application No. 60/971,252, filed on Sep. 10, 2007.

(51) Int. Cl.
*G03G 15/00* (2006.01)

(52) U.S. Cl. ..... 399/73; 399/90

(58) Field of Classification Search ..... 399/64, 399/73, 90; 324/456
See application file for complete search history.

(56) References Cited

U.S. PATENT DOCUMENTS 4,720,682 A * 1/1988 Ikushima et al. ..... 324/458
2007/0297830 A1* 12/2007 Kosuge ..... 399/128

FOREIGN PATENT DOCUMENTS

JP 63083743 A * 4/1988

* cited by examiner

*Primary Examiner* — David Gray
*Assistant Examiner* — Barnabas Fekete
(74) *Attorney, Agent, or Firm* — Patterson & Sheridan, LLP

(57) ABSTRACT

In an embodiment of the invention, a metal shield case and a metal shutter are electrically conducted to each other by using a contact part and are made to have the same potential. By this, the shutter does not electrically exert a bad influence on detection accuracy of a surface potential sensor, the closing performance of the shutter is improved, and the miniaturization or reduction in cost of the surface potential sensor can be realized.

18 Claims, 6 Drawing Sheets

SURFACE POTENTIAL DETECTING DEVICE OF IMAGE FORMING APPARATUS

CROSS-REFERENCE TO RELATED APPLICATION

This application is based upon and claims the benefit of priority from U.S. Provisional Application Ser. No. 60/971,252 filed on Sep. 10, 2007, the entire contents of which are incorporated herein by reference.

TECHNICAL FIELD

The present invention relates to a surface potential detecting device of an image forming apparatus, which detects the surface potential of a photoreceptor or the like used for the electrophotographic image forming apparatus.

BACKGROUND

In general, in an electrophotographic image forming apparatus, the quality of an image formed on a photoreceptor is improved by controlling an image forming process such as charging to a photoreceptor, exposure, and development. There is an apparatus in which the control of this image forming process is performed based on detection results from a detection sensor to detect the surface potential of the photoreceptor. Such a detection sensor detects the surface potential of the photoreceptor by, for example, a detection electrode in which electric charge is induced by the electrostatic induction of the photoreceptor. In order to prevent the electric charge induced in the detection electrode from being influenced by an external electric field, the detection electrode is covered with a metal shield case having a detection window. When scattering toner or the like enters the metal shield case, there is a fear that erroneous detection occurs, or the detection sensor is damaged.

Thus, hitherto, it is general that the surface potential detecting sensor is disposed at the upstream side of the developing process where there is less influence of the scattering toner.

However, in a tandem-type image forming apparatus including respective process units of charging, developing and the like which act on plural photoreceptors, miniaturization of the process units is required. Thus, in the tandem-type image forming apparatus, due to limitation in layout, there is a case where the detection sensor must be disposed at the downstream side of the developing process, where the influence of scattering toner is liable to occur. In this case, it is necessary to provide a shutter on a detection window in order to prevent that the scattering toner enters the metal shield case through the detection window of the detection sensor, and erroneous detection occurs or the detection sensor is damaged. However, when the shutter for opening and closing the detection window of the shield case is provided, there is a fear that the charging state of the shutter exerts a large influence on the detection sensor, output variation occurs in the detection electrode, and the surface potential of the photoreceptor is erroneously detected.

Then, it is desired to develop a surface potential detecting device of an image forming apparatus, which can accurately detect the surface potential of the photoreceptor without being influenced by a shutter.

SUMMARY

According to an aspect of the invention, a detection sensor having high accuracy and high durability, in which a detection window of a shield case is provided with a shutter to prevent contamination in the shield case, is not influenced by a charging state of the shutter and detects the surface potential of a photoreceptor with high accuracy.

According to an embodiment of the invention, a surface potential detecting device of an image forming apparatus includes a detection unit that is disposed near a charge body and detects a surface potential of the charge body, a container that has an opening on a surface facing the charge body and shields the detection unit, an opening and closing unit to open and close the opening, and a conduction member to electrically conduct the container and the opening and closing unit.

DETAILED DESCRIPTION

Figure 1:
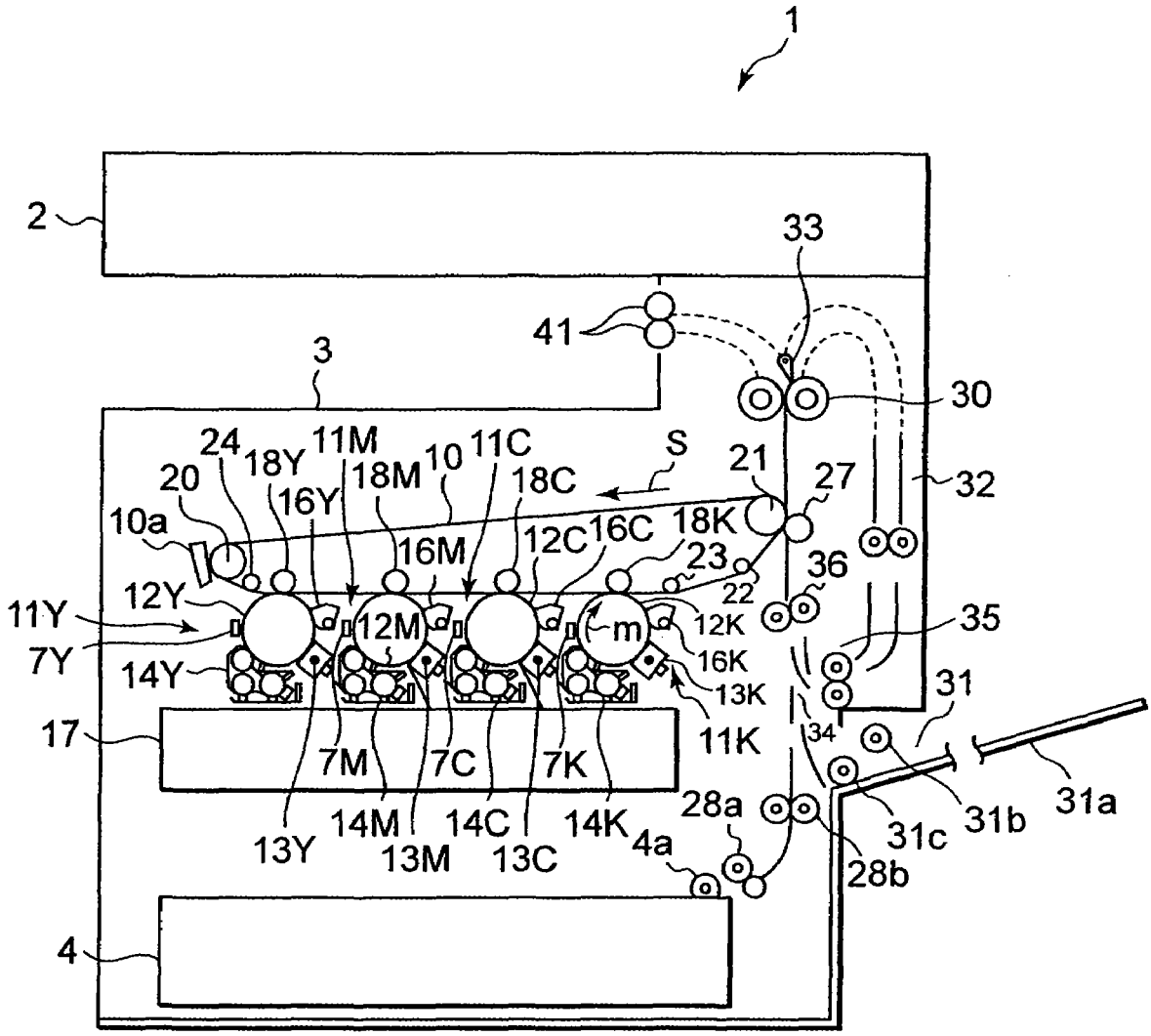
FIG. 1 is a schematic structural view showing a color copier of an embodiment of the invention.

Hereinafter, an embodiment of the invention will be described in detail with reference to the accompanying drawings. FIG. 1 is a schematic structural view showing a four-tandem color copier 1 as an image forming apparatus of the embodiment of the invention. The color copier 1 includes a scanner unit 2 and an in-body paper discharge unit 3 which are disposed on an upper side. The color copier 1 includes an image forming unit 11 having four sets of image forming stations 11Y, 11M, 11C and 11K of yellow (Y), magenta (M), cyan (C) and black (K) disposed in parallel along the lower side of an intermediate transfer belt 10.

Figure 2:
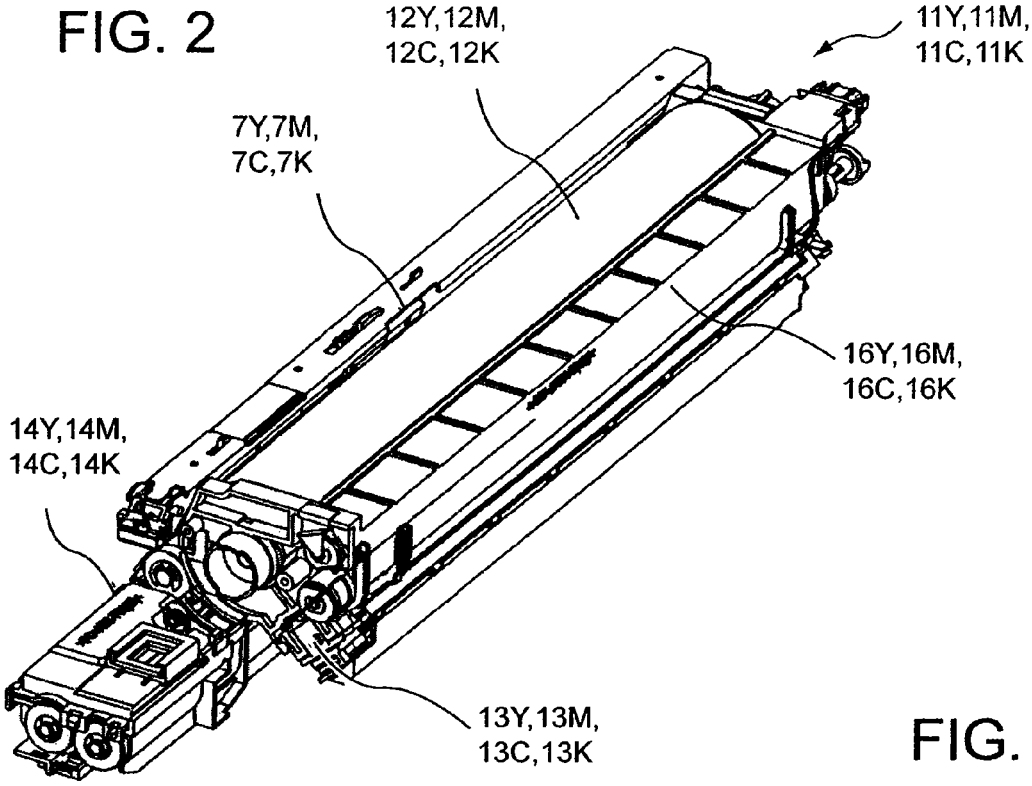
FIG. 2 is a schematic perspective view showing an image forming station of the embodiment of the invention.
Figure 3:
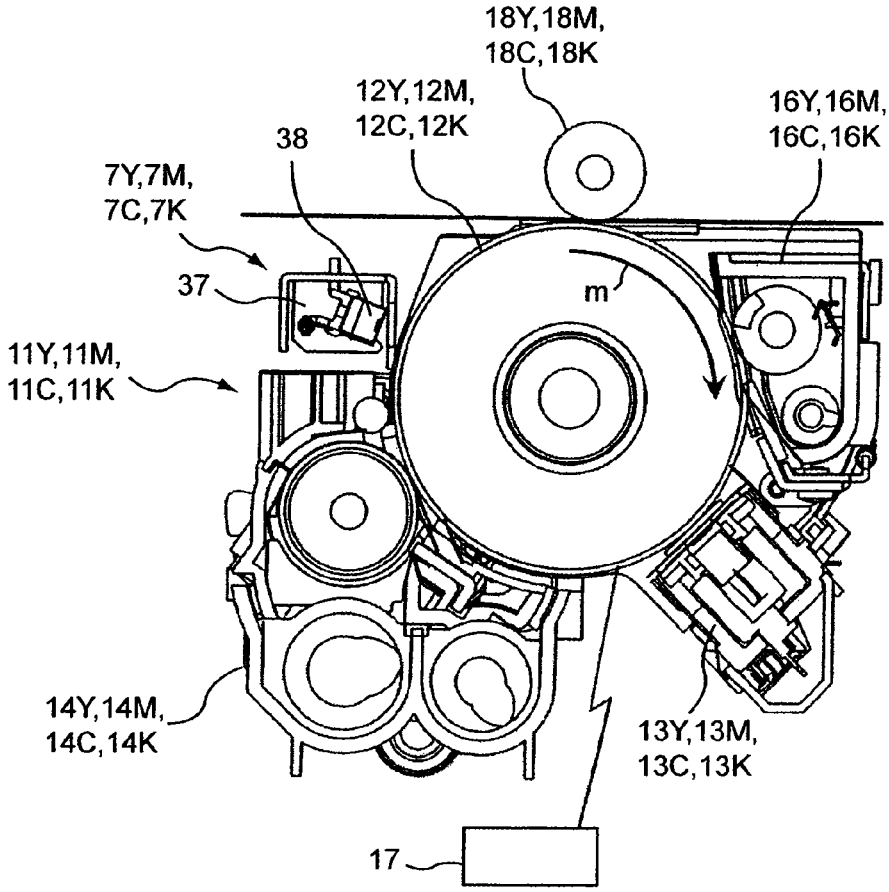
FIG. 3 is a schematic structural view showing the image forming station of the embodiment of the invention.

As shown in FIG. 2 and FIG. 3, the respective image forming stations 11Y, 11M, 11C and 11K include respective photoconductive drums 12Y, 12M, 12C and 12K which are charge bodies. Charging chargers 13Y, 13M, 13C and 13K, developing devices 14Y, 14M, 14C and 14K, surface potential sensors 7Y, 7M, 7C and 7K as surface potential detecting devices, and photoreceptor cleaning devices 16Y, 16M, 16C and 16K are disposed around the photoconductive drums 12Y, 12M, 12C and 12K respectively along rotation directions of arrow m directions. Respective exposure lights from a laser exposure device 17 are irradiated between the charging chargers 13Y, 13M, 13C and 13K and the developing devices 14Y, 14M, 14C and 14K around the photoconductive drums 12Y, 12M, 12C and 12K, and electrostatic latent images are formed on the photoconductive drums 12Y, 12M, 12C and 12K respectively.

The developing devices 14Y, 14M, 14C and 14K respectively have two-component developers made of toners of yellow (Y), magenta (M), cyan (C) or black (K) and carriers, and supply the toners to the electrostatic latent images on the photoconductive drums 12Y, 12M, 12C and 12K respectively.

The respective surface potential sensors 7Y, 7M, 7C and 7K detect the surface potentials of the respective photoconductive drums 12Y, 12M, 12C and 12K after charging steps of the charging chargers 13Y, 13M, 13C and 13K, exposure steps of the laser exposure device 17, and developing steps of the developing devices 14Y, 14M, 14C and 14K are performed respectively. The respective charging potentials of the charging chargers 13Y, 13M, 13C and 13K, the exposure intensity of the laser exposure device 17, the development biases of the developing devices 14Y, 14M, 14C and 14K, and the like can be controlled respectively according to the respective surface potentials of the photoconductive drums 12Y, 12M, 12C and 12K detected by the surface potential sensors 7Y, 7M, 7C and 7K.

The intermediate transfer belt 10 is stretched by a backup roller 21, a driven roller 20, and first to third tension rollers 22 to 24. The inter-mediate transfer belt 10 is opposite to and in contact with the photoconductive drums 12Y, 12M, 12C and 12K. Primary transfer rollers 18Y, 18M, 18C and 18K for primarily transferring toner images on the photoconductive drums 12Y, 12M, 12C and 12K to the intermediate transfer belt 10 respectively are provided at positions of the intermediate transfer belt 10 opposite to the photoconductive drums 12Y, 12M, 12C and 12K.

A secondary transfer roller 27 is disposed in a secondary transfer unit at a transfer position of the intermediate transfer belt 10 supported by the backup roller 21. In the secondary transfer unit, a specified secondary transfer bias is applied to the backup roller 21. When a sheet paper as a recording medium passes through between the intermediate transfer belt 10 and the secondary transfer roller 27, the toner images on the intermediate transfer belt 10 are secondarily transferred onto the sheet paper. After the secondary transfer is ended, the intermediate transfer belt 10 is cleaned by a belt cleaner 10*a*.

A paper feed cassette 4 for feeding sheet papers in a direction toward the secondary transfer roller 27 is provided below the laser exposure device 17. A manual feed mechanism 31 for manually feeding sheet papers is provided on the right side of the color copier 1.

A pickup roller 4*a*, a separation roller 28*a*, a carrying roller 28*b* and a registration roller pair 36 are provided between the paper feed cassette 4 and the secondary transfer roller 27. A manual feed pickup roller 31*b* and a manual feed separation roller 31*c* are provided between a manual feed tray 31*a* of the manual feed mechanism 31 and the registration roller pair 36. Further, a fixing device 30 for fixing the toner image transferred on the sheet paper in the secondary transfer unit by a heat treatment is provided downstream of the secondary transfer unit along the direction of a vertical carrying path 34. A gate 33 for selectively feeding the sheet paper in the direction toward a paper discharge roller 41 or the direction toward a re-carrying unit 32 is provided downstream of the fixing device 30. The sheet paper guided to the paper discharge roller 41 is discharged to the in-body paper discharge unit 3. Besides, the sheet paper guided to the re-carrying unit 32 is again guided in the direction toward the secondary transfer roller 27.

The image forming station 11Y integrally includes the photoconductive drum 12Y and the process unit, and is provided to be attachable to and detachable from the body of the color copier 1. The process unit represents at least one of the charging charger 13Y, the developing device 14Y and the photoreceptor cleaning device 16Y. The image forming stations 11M, 11C and 11K have the same structure as the image forming station 11Y, and each of the image forming stations 11Y, 11M, 11C and 11K may be attachable to and detachable from the image forming apparatus, or they may be attachable to and detachable from the image forming apparatus as the integral image forming unit 11.

Next, the surface potential sensors 7Y, 7M, 7C and 7K will be described in detail. Incidentally, since any of the surface potential sensors 7Y, 7M, 7C and 7K have the same structure, a description will be made while using one of them as an example. For example, as shown in FIG. 3, the surface potential sensor 7Y of the image forming station 11Y of yellow (Y) contains a detection element 38 as a detection unit in a metal shield case 37 as a container for shielding an external electric field.

Figure 4:
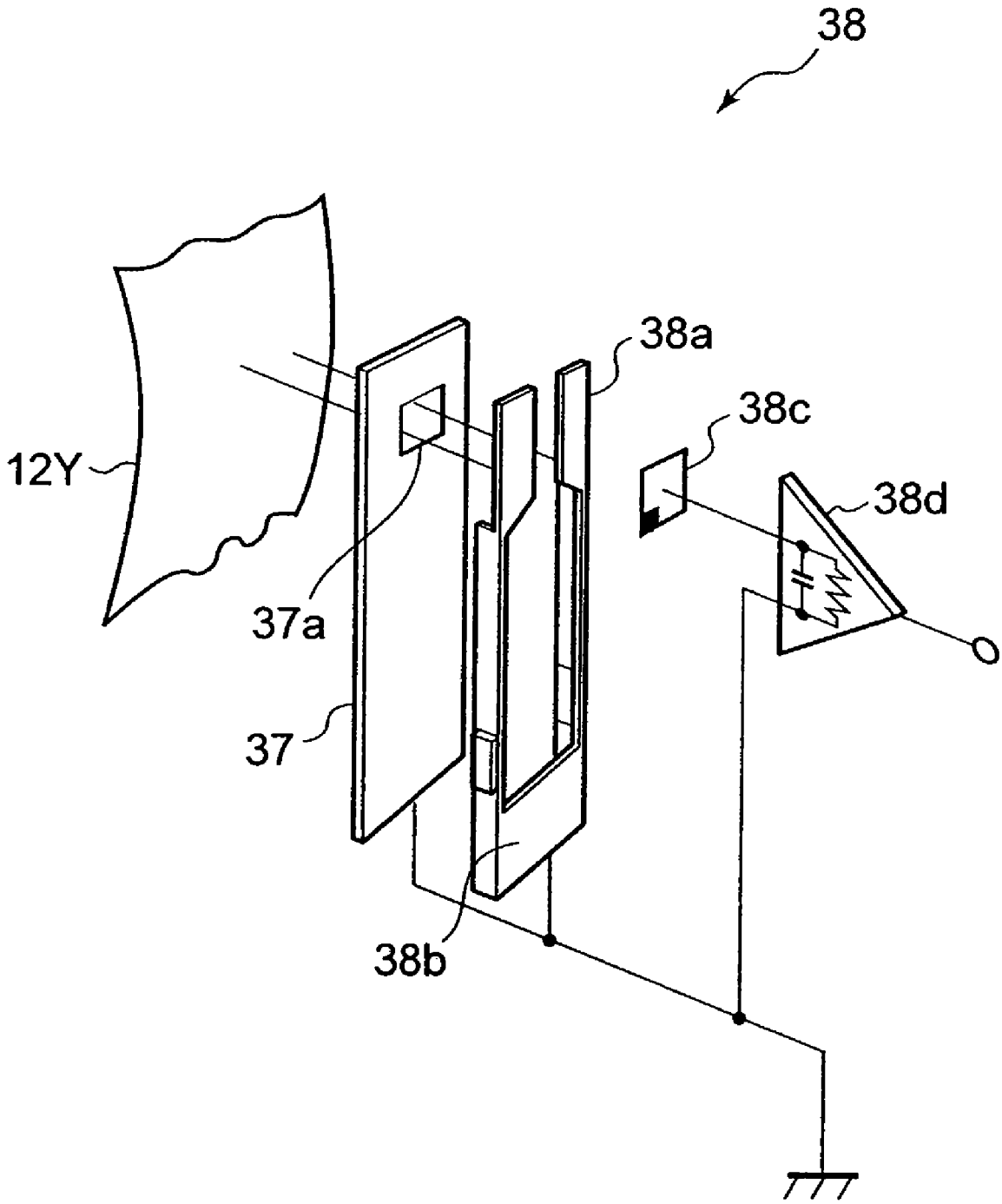
FIG. 4 is a schematic structural view showing a surface potential sensor of the embodiment of the invention.

The metal shield case 37 is disposed opposed to the photoconductive drum 12Y with a gap of, for example, several mm provided therebetween. A detection window 37*a* as an opening on which an electric flux line generated from the photoconductive drum 12Y is incident is provided on a surface of the metal shield case 37 opposite to the photoconductive drum 12Y. The detection window 37*a* is formed to have a size of, for example, 2 mm×2 mm. For example, as shown in FIG. 4, the detection element 38 includes a chopper 38*a* having a shielding blade to the electric flux line from the photoconductive drum 12Y, a piezoelectric element 38*b* to drive the chopper 38*a*, a detection electrode 38*c* to detect the surface potential, and a detection circuit 38*d* to convert a periodic potential change induced in the detection electrode 38*c* into an AC voltage.

A shutter 42 as an opening and closing unit to open and close the detection window 37*a* is slidably provided on the front of the detection window 37*a* of the metal shield case 37. The shutter 42 is provided with a shutter window 42*a* of a size of, for example, 3 mm×3 mm. When the shutter 42 is put in an open state, the shutter window 42*a* overlaps the detection window 37*a* of the metal shield case 37 and opens the detection window 37*a*. When the shutter 42 is put in a closed state, an interval $\alpha$ between the detection window 37*a* and the shutter window 42*a* is, for example, 5 mm.

Figure 5:
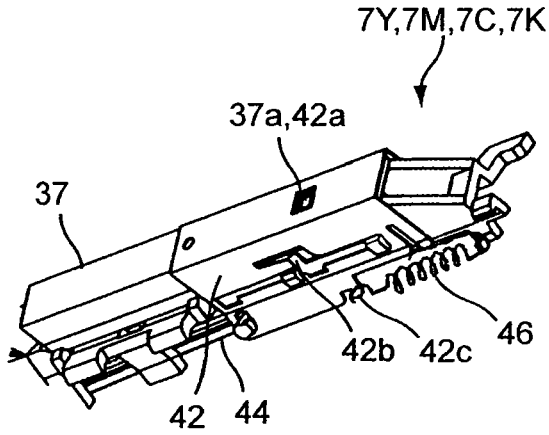
FIG. 5 is a partial schematic perspective view showing, from below, a state in which a shutter of the surface potential sensor of the embodiment of the invention is opened.
Figure 6:
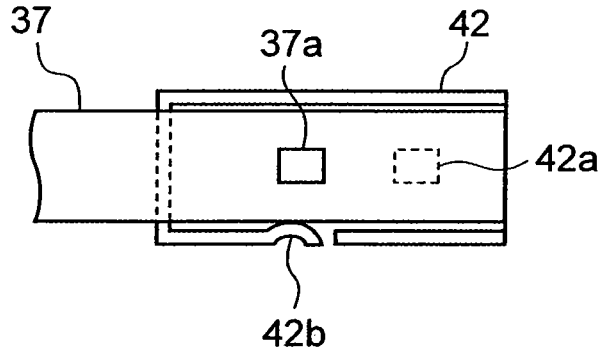
FIG. 6 is an explanatory view showing contact between a contact part of the shutter of the embodiment of the invention and a metal shield case.

The shutter 42 is made of, for example, a metal having elasticity. As shown in FIG. 5 and FIG. 6, a part of the shutter 42 is formed to protrude toward the metal shield case 37, and a contact part 42*b* as a conduction member, which is always in contact with the metal shield case 37, is integrally formed. The contact part 42*b* is in contact with the metal shield case 37, so that the metal shield case 37 and the shutter 42 are always electrically conducted to each other, and have the same potential.

Figure 7:
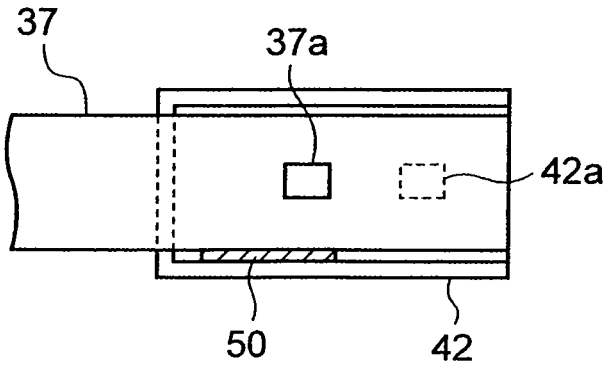
FIG. 7 is an explanatory view showing a case where a slidable conductive polymer polyethylene sheet is used instead of the contact part of the shutter of the embodiment of the invention.

Incidentally, as the conduction member, the contact part may be provided on the metal shield case side, not the shutter side. Further, the conduction member is not formed integrally with the shutter, but may be, for example, a slidable conductive polymer polyethylene sheet 50 sandwiched between the metal shield case 37 and the shutter 42 as shown in FIG. 7. When the contact part 42*b* is used as the conduction member, there is a fear that the metal shield case 37 is worn away by the contact part 42*b* at the time of sliding of the shutter 42, and defective operation occurs. However, when the polymer polyethylene sheet 50 is used as the conduction member, it is possible to prevent the metal shield case 37 from being worn away.

A driving end of a link member 44 driven by a solenoid 43 is attached to the shutter 42. Further, a spring 46 for always urging the shutter 42 in an arrow v direction as a direction of closing the detection window 37*a* is attached to a hook unit 42*c* of the shutter 42. When the solenoid 43 is turned on, the shutter 42 is slid and moved in the direction of opening the detection window 37*a* by the link member 44. When the solenoid 43 is turned off, the shutter 42 is slid and moved in the direction of closing the detection window 37*a* by the spring 46.

Figure 8:
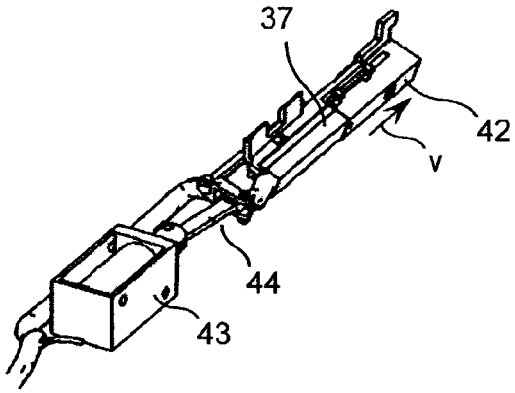
FIG. 8 is a schematic perspective view showing, from above, a state where the shutter of the surface potential sensor of the embodiment of the invention is closed.
Figure 10:
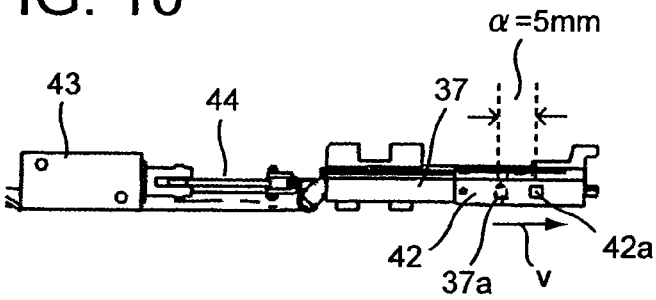
FIG. 10 is a front view showing a state where the shutter of the surface potential sensor of the embodiment of the invention is closed.

Next, the operation of the surface potential sensors 7Y, 7M, 7C and 7K will be described. While the surface potentials of the photoconductive drums 12Y, 12M, 12C and 12K are not detected, the solenoid 43 of each of the surface potential sensors 7Y, 7M, 7C and 7K is turned off. By this, as shown in FIG. 8 and FIG. 10, the shutter 42 is urged by the spring 46, is pulled in the arrow v direction, and is put in the closed state to close the detection window 37*a*. At this time, as shown in FIG. 10, the detection window 37*a* and the shutter window 42*a* are apart from each other by 5 mm. Accordingly, even if each of the surface potential sensor 7Y, 7M, 7C and 7K is disposed downstream of the each of the developing device 14Y, 14M, 14C and 14K in the rotation directions of the photoconductive drums 12Y, 12M, 12C and 12K respectively, it is possible to prevent scattering toner from entering the metal shield case 37.

Figure 9:
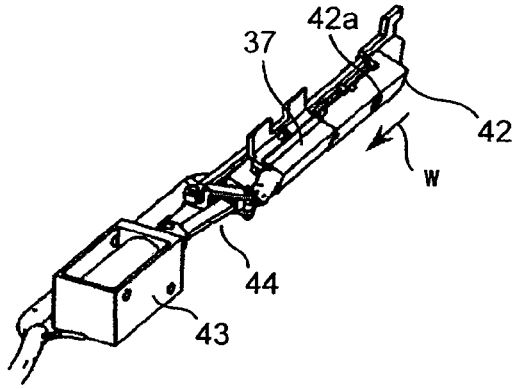
FIG. 9 is a schematic perspective view showing, from above, a state where the shutter of the surface potential sensor of the embodiment of the invention is opened.
Figure 11:
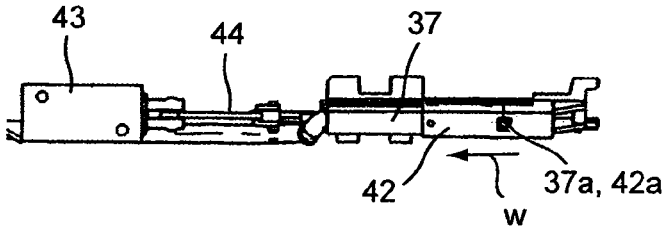
FIG. 11 is a front view showing a state where the shutter of the surface potential sensor of the embodiment of the invention is opened.

Thereafter, when the surface potential of each of the photoconductive drum 12Y, 12M, 12C and 12K is detected, the solenoid 43 is turned on. By this, as shown in FIG. 9 and FIG. 11, the shutter 42 is pulled by the link member 44 by about 7 mm in an arrow w direction. By this, the shutter 42 is put in the open state, and the shutter window 42*a* overlaps the detection window 37*a*, and opens the detection window 37*a*. Next, the detection element 38 detects the surface potential. That is, a drive voltage is applied to the piezoelectric element 38*b* to periodically open and close the shielding blade of the chopper 38*a*. By this, the detection electrode 38*c* detects an induced periodic potential change, the detection circuit 38*d* converts this potential change into an AC voltage, and the surface potential of each of the photoconductive drum 12Y, 12M, 12C and 12K is detected.

As stated above, while the shutter 42 is opened and closed in front of the detection window 37*a*, the contact part 42*b* provided on the shutter 42 is always in slide contact with the metal shield case 37. That is, the metal shield case 37 and the shutter 42 are always electrically conducted to each other, and have the same potential. Accordingly, although the frame of the shutter window 42*a* is close to the periphery of the detection window 37*a*, the detection element 38 does not receive electrical influence from the shutter 42 and can obtain excellent detection results.

Figure 12:
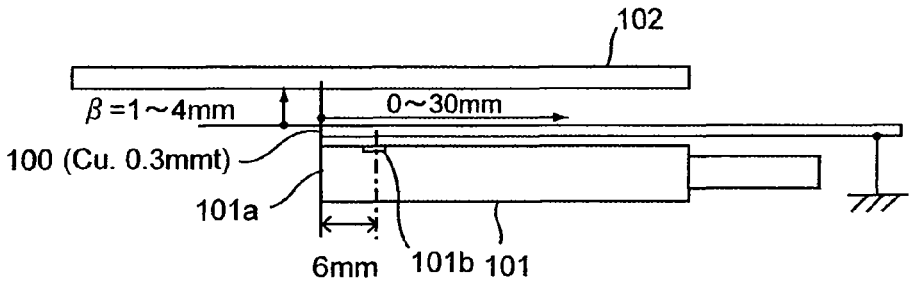
FIG. 12 is an explanatory view showing a test method of a comparative example.

Here, as a comparative example, a test is performed on the influence of the shutter exerted on detection results when the surface potential of the measurement electrode is detected while the shield case of the surface potential sensor and the shutter are not electrically conducted. As shown in FIG. 12, the test is performed as follows. That is, a surface potential sensor 101 having a shutter 100 is made opposite to a measurement electrode 102. The shutter 100 is made of a copper plate having a thickness of 0.3 mm. The measurement electrode 102 is charged to −500 V, and the shutter 100 is grounded. The surface potential sensor 101 has a detection window 101*b* of 2 mm×2 mm at a position apart from a sensor end 101*a* by 5 mm. Accordingly, the distance between the sensor end 101*a* and the center of the detection window 101*b* is 6 mm. In the state where the shutter 100 is closed, the shutter end 100*a* and the sensor end 101*a* have the same phase.

Figure 13:
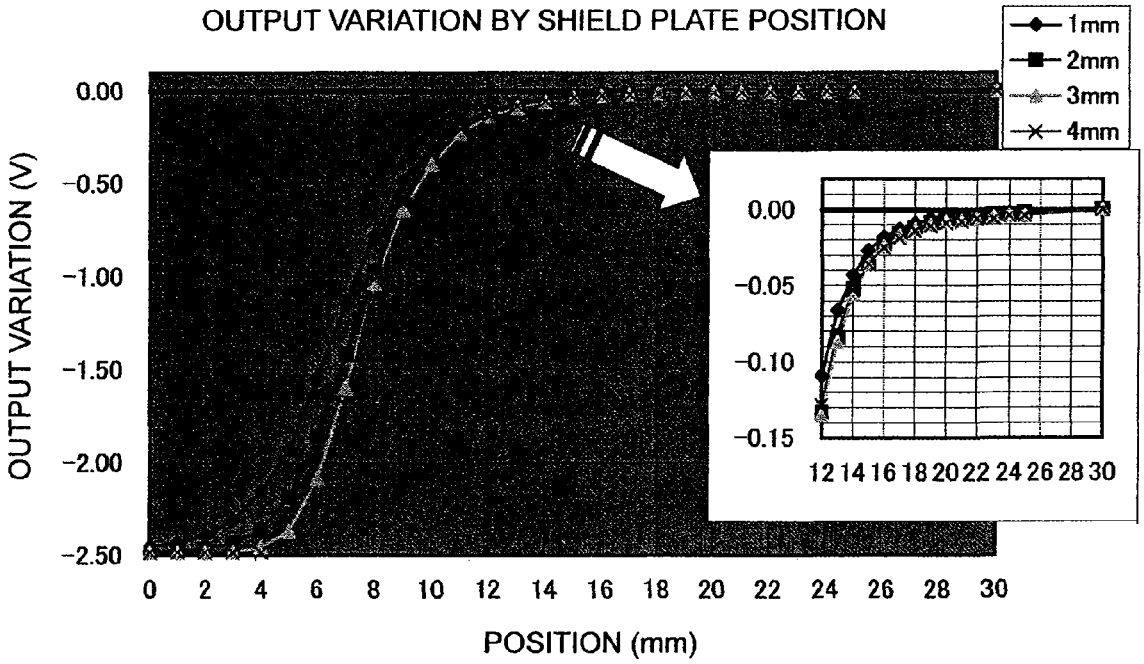
FIG. 13 is a graph showing output variation of a surface potential sensor according to a shutter position in the comparative example.

As a test condition, an interval β between the shutter 100 and the measurement electrode 102 is changed from 1 mm to 4 mm in a unit of 1 mm, and at each interval, the shutter 100 is slid by 1 to 30 mm, and the surface potential of the measurement electrode 102 is detected. FIG. 13 shows an output variation (error between a detection result by the surface potential sensor 101 and an actual potential (−500V) of the measurement electrode 102) of the surface potential sensor 101 according to the position of the shutter 100.

As is apparent from FIG. 13, unless the shutter end 100*a* is apart from the detection window 101*b* by 20 mm or more, the output of the surface potential sensor 101 receives the electric influence of the grounded shutter 100 and is changed. For example, in any case where the interval β between the shutter 100 and the measurement electrode 102 is 1 to 4 mm, when the shutter 100 is slid by 7 mm and the whole surface of the detection window 101*b* is opened, the output of the surface potential sensor 101 changes by −1.2 V or more. Thereafter, as the shutter end 100*a* is separated from the detection window 101*b*, the variation of the output of the surface potential sensor 101 becomes less, and when the shutter end 100*a* is separated from the detection window 101*b* by 22 mm, the variation of the output of the surface potential sensor 101 becomes 0V.

As in this comparative example, when the potentials of the shutter 100 and the surface potential sensor 101 are different from each other, the surface potential sensor 101 receives the influence of the potential of the shutter 100, and the output variation occurs. Such output variation occurs when the shutter is made of plastic, or the metal shutter is grounded or floated.

On the other hand, in this embodiment, the metal shield case 37 and the metal shutter 42 are electrically conducted through the contact part 42*b* formed on the shutter 42, and are made to have the same potential. By this, the detection element 38 does not receive the electrical influence of the shutter 42.

That is, according to this embodiment, when the detection window 37*a* is opened, even if the member of the shutter 42 is close to the periphery of the detection window 37*a*, the detection element 38 can detect the surface potentials of the photoconductive drums 12Y, 12M, 12C and 12K with high accuracy. Accordingly, the shutter window 42*a* of the shutter 42 to open and close the detection window 37*a* of the metal shield case 37 can be formed to have substantially the same size as the detection window 37*a*. As a result, even if the surface potential sensors 7Y, 7M, 7C and 7K are disposed downstream of the developing devices 14Y, 14M, 14C and 14K where scattering toner is liable to be generated respectively, the shutter 42 can more certainly prevent the scattering toner from entering the metal shield case 37 through a gap relative to the shutter window 42*a* in the closed state, and can improve the closing performance. Besides, the slide range of the shutter 42 for opening and closing the detection window 37*a* can be reduced. As a result, it is possible to achieve the miniaturization and the reduction in cost of the solenoid 43, the spring 46 or the like, and consequently, the miniaturization and the reduction in cost of the surface potential sensors 7Y, 7M, 7C and 7K.

Incidentally, the invention is not limited to the above embodiment, and can be variously modified within the scope of the invention. For example, the structure of the detection unit is arbitrary. Besides, the material of the container is not limited as long as it shields the external electric field and has conductivity. The material of the opening and closing unit is not limited as long as it is electrically conducted to the container. The opening and closing operation of the opening and closing unit is not also limited, and the opening of the container may be opened and closed by a wiper system. Further, the material, shape and the like of the conduction member are not limited as long as it can electrically conduct the container and the opening and closing unit.

What is claimed is:

1. A surface potential detecting device of an image forming apparatus, comprising:

a detection unit that is disposed opposite a charge body and detects a surface potential of the charge body;

a container that includes an opening on a surface facing the charge body and shields the detection unit;

an opening and closing unit provided between the charge body and the opening and configured to open and close a whole surface of the opening; and a conduction member to electrically connect the container and the opening and closing unit.

2. The device according to claim 1, wherein the conduction member is provided on the opening and closing unit and has a contact member that is in contact with the container.

3. The device according to claim 2, wherein the opening and closing unit has a conductive member having elasticity, and the contact member is formed integrally with the opening and closing unit.

4. The device according to claim 1, wherein the conduction member is provided on the container and has a contact member that is in contact with the opening and closing unit.

5. The device according to claim 1, wherein the conduction member has a conductive member sandwiched between the container and the opening and closing unit.

6. The device according to claim 1, wherein the container is a metal shield case.

7. An image forming apparatus comprising:

an image forming unit that exposes a charge body after being charged, and develops a formed electrostatic latent image to form a toner image on the charge body;

a detection unit that is disposed near the charge body after being charged and detects a surface potential of the charge body;

a container that includes an opening on a surface facing the charge body and shields the detection unit;

an opening and closing unit provided between the charge body and the container and configured to open and close a whole surface of the opening; and a conduction member to electrically connect the container and the opening and closing unit.

8. The apparatus according to claim 7, wherein the conduction member is provided on the opening and closing unit and has a contact member that is in contact with the container.

9. The apparatus according to claim 8, wherein the opening and closing unit has a conductive member having elasticity, and the contact member is formed integrally with the opening and closing unit.

10. The apparatus according to claim 7, wherein the conduction member is provided on the container and has a contact member that is in contact with the opening and closing unit.

11. The apparatus according to claim 7, wherein the conduction member has a conductive member sandwiched between the container and the opening and closing unit.

12. The apparatus according to claim 7, wherein the container is a metal shield case.

13. The apparatus according to claim 7, wherein the image forming unit has a developing device to develop the electrostatic latent image formed on the charge body, and the detection unit is close to the charge body after development by the developing device.

14. The apparatus according to claim 7, wherein the image forming unit has a plurality of the image forming stations for respective colors of the toner image.

15. A surface potential detecting method of an image forming apparatus, comprising:

opening a whole surface of an opening of a container by sliding an opening and closing unit that is disposed between a charge body and the container;

causing the opening and closing unit to have a same potential as the container; and detecting, by a detection unit in the container, a surface potential of the charge body after being charged.

16. The method according to claim 15, wherein the opening and closing unit is brought into contact with the container to cause the opening and closing unit to have the same potential as the container.

17. The method according to claim 15, wherein a conductive member is sandwiched between the opening and closing unit and the container to cause the opening and closing unit to have the same potential as the container.

18. The method according to claim 15, wherein the surface potential of the charge body is detected for the charge body after charging, exposing and developing are performed.

* * * * *